United States Patent [19]

Lancaster et al.

[11] 4,302,920

[45] Dec. 1, 1981

[54] FILM WEB DRIVE STRETCH WRAPPING APPARATUS AND PROCESS

[75] Inventors: Patrick R. Lancaster, Anchorage; William G. Lancaster, Louisville, both of Ky.

[73] Assignee: Lantech Inc., Louisville, Ky.

[21] Appl. No.: 96,384

[22] Filed: Nov. 21, 1979

[51] Int. Cl.[3] ..... B65B 11/04

[52] U.S. Cl. ..... 53/399; 53/441; 53/556; 53/587

[58] Field of Search ..... 53/399, 441, 556, 587, 53/588, 211, 465; 264/288.4, 288.8; 26/71; 28/245; 242/67.3, 75.2

[56] References Cited

U.S. PATENT DOCUMENTS

| | | | |
|---|---|---|---|
| 2,054,603 | 9/1936 | Leaver, Jr. . | |
| 2,124,770 | 7/1938 | Evans . | |
| 2,330,629 | 9/1943 | Schmidt . | |
| 2,547,399 | 4/1951 | Leveridge | 242/75.2 |
| 2,630,751 | 3/1953 | Cranston et al. . | |
| 2,743,562 | 5/1956 | Dawson et al. . | |
| 2,767,435 | 10/1956 | Alles | 264/288.4 |
| 3,003,297 | 10/1961 | Broadhead et al. . | |
| 3,207,060 | 9/1965 | Smith . | |
| 3,309,839 | 3/1967 | Lyon . | |
| 3,324,789 | 6/1967 | Buettner . | |
| 3,331,312 | 7/1967 | Leslie et al. . | |
| 3,412,192 | 11/1968 | Clapson | 242/75.2 |
| 3,500,519 | 3/1970 | Stanley | 28/245 |
| 3,514,920 | 6/1970 | Hoffler et al. . | |
| 3,590,549 | 7/1971 | Zelnick . | |
| 3,626,654 | 12/1971 | Hoffler et al. . | |
| 3,788,199 | 1/1974 | Sato et al. . | |
| 3,793,798 | 2/1974 | Lancaster et al. | 53/588 |
| 3,795,086 | 3/1974 | Hiss | 53/211 |
| 3,820,451 | 6/1974 | Tanaka . | |
| 3,863,425 | 2/1975 | Edwards et al. | 53/211 |
| 3,867,806 | 2/1975 | Lancaster et al. . | |
| 3,986,611 | 10/1976 | Dreher . | |
| 4,077,179 | 3/1978 | Lancaster et al. | 53/588 |
| 4,079,565 | 3/1978 | Lancaster et al. | 53/588 |
| 4,109,445 | 8/1978 | Shulman | 53/588 |

FOREIGN PATENT DOCUMENTS

| | | |
|---|---|---|
| 2281275 | 5/1976 | France . |

*Primary Examiner*—John Sipos

*Attorney, Agent, or Firm*—Gipple & Hale

[57] ABSTRACT

A process and apparatus for applying stretchable plastic film to loads for containment of the loads using two connected rollers driven by the film web so that the rollers are driven at different speeds to elongate the plastic film beyond its yield point and wrapping the elongated film after it has been stretched past its yield point around a rotating load. A roller can be added to the apparatus to increase the set time for the elongated film after it is stretched by the connected rollers. In addition, a web narrowing device may be placed upstream or downstream from the apparatus to reduce the hazard of edge tear under high elongation forces.

34 Claims, 16 Drawing Figures

36
34
35
44
46
48
37
35'
50
38
54
138
40
68
70
66
62
58
60
40
64'
42
56
142
35"
52

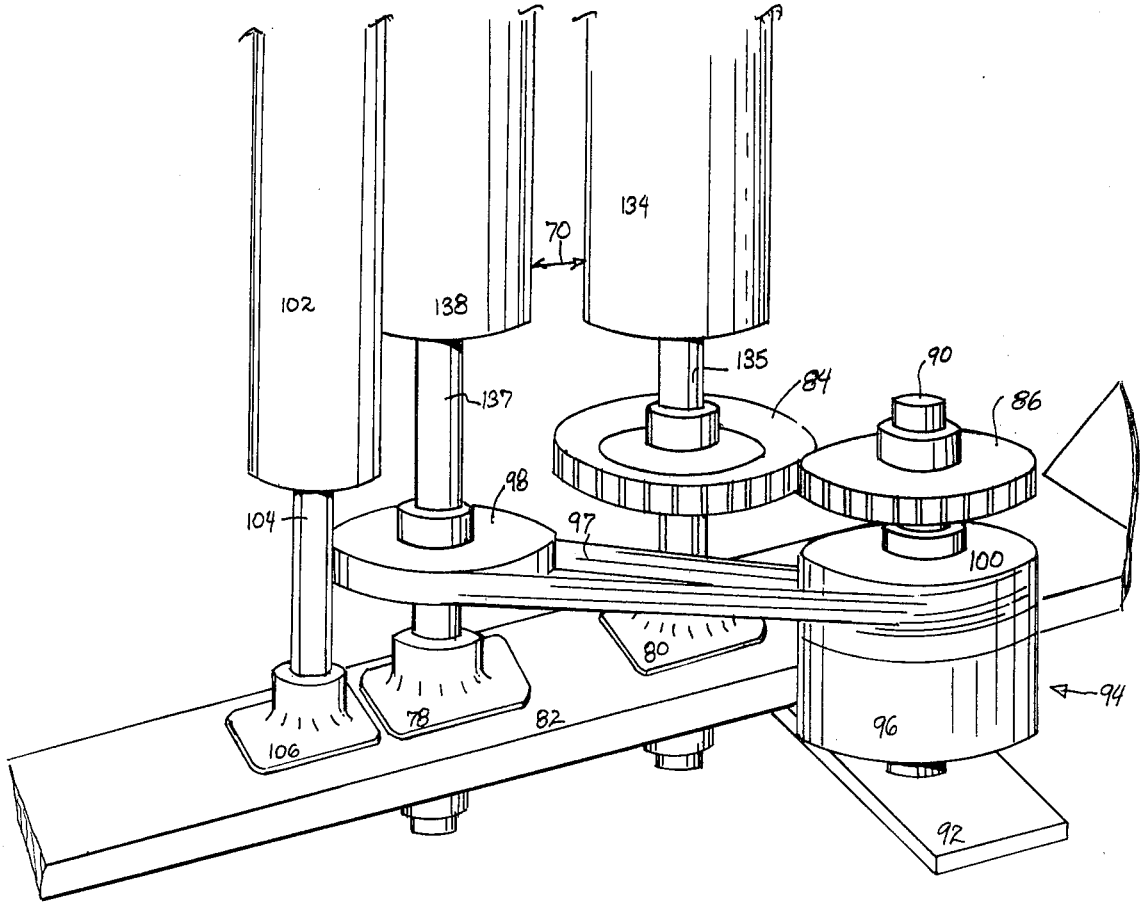
Fig 5
Fig 6
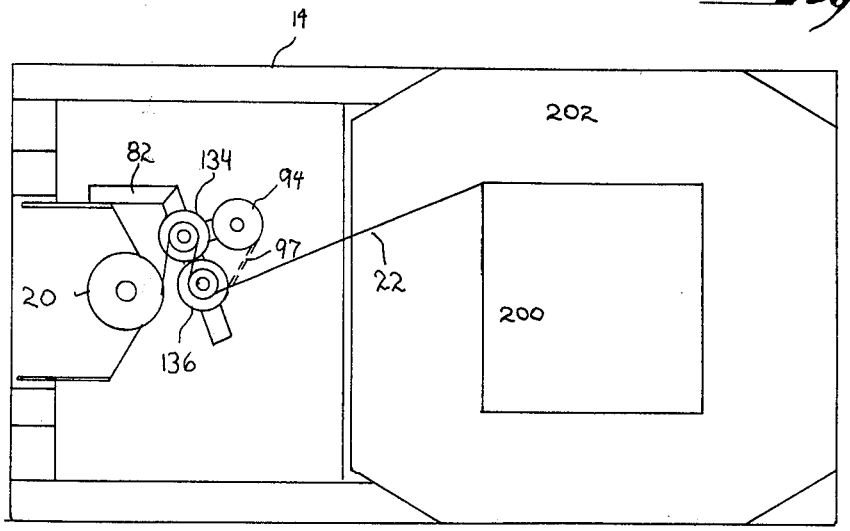

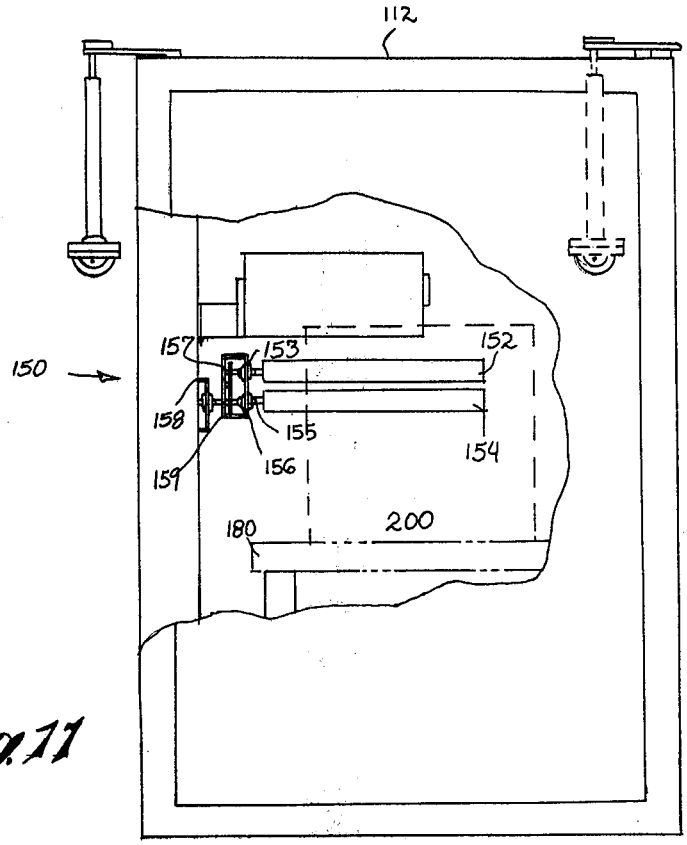
Fig. 11
Fig. 13
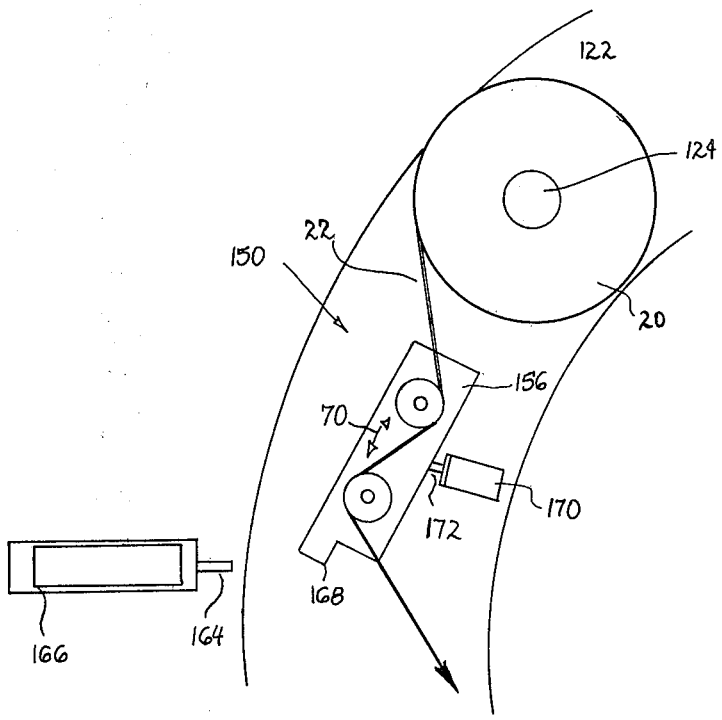

FILM WEB DRIVE STRETCH WRAPPING APPARATUS AND PROCESS

BACKGROUND OF THE INVENTION

The present invention generally relates to packaging and more particularly to an apparatus and method for making unitary packages which hold a plurality of components, each package containing a load wrapped in a web of stretched film.

Case packing or boxing is a common way of shipping multiple unit products. The multiple unit products are generally stacked in a corrugated box or are wrapped with kraft paper with the ends of the kraft paper being glued or taped. Another way of shipping such products is by putting a sleeve or covering of heat shrinkable film around the products and shrinking the sleeve to form a unitized package. The use of heat shrinkable film is described in U.S. Pat. Nos. 3,793,798; 3,626,645; 3,590,509 and 3,514,920. A discussion of this art is set forth in U.S. Pat. No. 3,867,806.

The present invention does not require a structural seal and therefore can use any type of stretchable plastic material. The invention is designed to function with stretchable film webs such as nylon, polypropylene, PVC, polybutylene, polyethylene or any copolymer or blends of the aforementioned stretchable films.

The use of spiral wrapping machinery is well known in the art. One such apparatus is shown by U.S. Pat. No. 3,863,425 in which film is guided from a roll and wrapped around a cylindrical load in a spiral configuration. A carriage drives the film roll adjacent the surface of the load to deposit a spiral wrap around the load and returns in the opposite direction to deposit another spiral overwrap around the load.

It has previously been disclosed in U.S. Pat. No. 3,788,199 to spirally wind tapes in such a manner that they overlap each other to provide suitable space therebetween when breatheability is required. In this disclosure, a heavy duty bag is prepared by spirally winding stretched tapes of synthetic resin in opposite directions, so that they intersect each other to form a plurality of superimposed cylindrical bodies which are bonded together to form a cylindrical network. The spirally wound inner and outer tapes of the superimposed cylindrical body intersect each other at a suitable angle, depending upon the application intended, the preferred embodiment having substantially equal longitudinal transfer strength. In this preferred embodiment, the tapes intersect each other at an angle of about 90°. The angle defined by the tapes constituting the cylindrical network may be determined by varying the interrelationship between the travelling speed of the endless belts carrying the tape and the rotating speed of the bobbin holders, which rotate a plurality of tape bobbins to deposit the tape onto the moveable belt. The previously indicated patents rely on heat shrink material, adhesives, a heat seal or the tacky nature of the film to hold the outer layer of wrap in a fixed position.

In U.S. Pat. No. 3,003,297, a rotatable cutting and holding mechanism is used to place a tape on a box and cut it off with the process being repeated for each box.

Additional references of interest which are pertinent to rotatable drives for wrapping packages are disclosed in U.S. Pat. Nos. 3,820,451; 3,331,312; 3,324,789; 3,309,839; 3,207,060; 2,743,562; 2,630,751; 2,330,629; 2,054,603 and 2,124,770.

Other applications in packaging are shown in U.S. Pat. Nos. 3,514,920 and 3,793,798 in which heat shrink film is wrapped around a pallet supporting a plurality of cartons. A full web apparatus which wraps stretched film around a rotating load is disclosed in U.S. Pat. No. 3,867,806 assigned to Lantech, Inc. A similar full web apparatus using a tensioned cling film wrapped around a rotating load is shown by U.S. Pat. No. 3,986,611 while another apparatus using a tacky PVC film is disclosed in U.S. Pat. No. 3,795,086.

Stationary loads which are brought to a loading area and are wrapped by a rotating member which dispenses stretched film around a load are disclosed in U.S. Pat. Nos. 4,709,565 and 4,109,445. U.S. Pat. No. 4,079,565 discloses a full web vertical wrap of the load, while U.S. Pat. No. 4,109,445 discloses the horizontal spiral wrap of a load.

The elasticity of the stretched plastic film holds the products of the load under more tension than either the shrink wrap or the kraft wrap, particularly with products which settle when packaged. The effectiveness of stretched plastic film in holding a load together is a function of the containment or stretch force being placed on the load and the ultimate strength of the total layered film wrap. These two functions are determined by the modulus or hardness of the film after stretch has occurred and the ultimate strength of the film after application. Containment force is currently achieved by maximizing elongation until just below a critical point where braking of the film occurs. Virtually all stretch films on the market today including products of Mobil Chemical Company (Mobil-X, Mobil-C, Mobil-H), Borden Resinite Division PS-26, Consolidated Thermoplastics, Presto, PPD and others are consistently stretched less than 30% in applications because of irregularities in film braking systems. These systems depend upon friction induced drag either directly on the film through a bar assembly such as that used by the Radient Engineering Company or indirectly such as that shown in U.S. Pat. Nos. 3,867,806 and 4,077,179.

All of these prior art apparatuses suffer from a severe limitation which relates to cost per unit load for film unitization. Friction brake devices do not maintain a consistent force. These brake devices are subject to variation due to their physical construction and their sensitivity to speed change caused by passage of corners of the load, and the resultant sudden speed up and slow down of film unwind. A typical 40" × 48" pallet load will incur a surface speed change of more than 40% with each quarter turn. Higher turntable speeds of 12 to 18 rpm produce additional resonating forces which change with a roll consumption and its resultant weight change. Additional limitations on maximum elongation are caused by film roll imperfections and guage variations which accentuate the force variations described above to produce film ruptures. Even though all of the films previously described carry manufacturer's specified elongation rates above 300%, these rates cannot be approaced because of limitations imposed by friction-type brake devices.

One problem with shrink and non-cling stretch film packaging in addition to the fact that they do not allow a load to breathe is that the primary strength and reliability of the package is determined by the consistent quality of the seal. These seals depend on a careful maintenance of the sealing jaw and are never as strong as the film itself. The time that it takes to make the seals is a limiting factor on the possible speeds of most shrink systems with the additional problem that some stretchable materials, as for example, stretch netting, or narrow width film cannot be effectively heat sealed.

In view of the previously stated characteristics of film, the previously noted stretch machines including machines manufactured by Lantech Inc.; Kaufman; Infra-Pak; PS & D: Allied Automatic; I. P. M.; and Mima have limited capabilities.

When high elongation rates of film are attempted, the forces frequently either disrupt the stacking pattern of the units or pull the load off of the turntable.

In addition non-vertical sides and corners on an irregular load place extreme forces on a small area of film during stretching, thereby causing a partial rupture at a point well below the force achieveable on a flat side. This partial rupture causes a transfer of force to the remaining portion of the web. This force is frequently sufficient to produce a "zippering" of the entire film web.

SUMMARY OF THE INVENTION

A process and apparatus for applying stretchable plastic film to pallet loads for containment of the loads using a pre-stretching mechanism in the form of two connected sets of rollers driven by the film web at different speeds to elongate the plastic film between the connected rollers as the film is wrapped around a rotating pallet. A web narrowing device may be placed upstream or downstream from the mechanism to reduce the hazard of edge tears under high elongation forces.

The present invention provides an apparatus and process which pre-stretches film before wrapping the film around a load so that the film may be elongated beyond its yield point before it is wrapped around the load holding the load under compressive forces.

Most plastic films when stretched above their yield point gain significantly in modulus and ultimate strength. The typical polyethylene will multiply three times the ultimate strength in pounds per square inch of cross sectional area after being elongated approximately 300 percent. This significant increase in strength begins approximately when the yield point is exceeded in the elongation phase. The yield point is achieved between 15 and 40 percent stretch for virtually all stretch films being used today. Limitations of friction-based constant force devices prevent current stretch wrap applications from achieving the higher levels of containment force and ultimate strength available in the foremost plastic films. Achieving the higher elongation levels with the invention allows fewer revolutions of film for equivalent holding power. These higher levels of stretch not only allow fewer revolutions of film but also less film by weight for each revolution.

Thus, the present invention allows at least double the practical level of elongation currently experienced with prior art "brake" systems. This gives higher containment forces and/or lower film costs to the end user.

Furthermore, the invention allows for more precise control of elongation allowing the user to get maximum cost efficiency from the new high yield films, along with higher film strength or modulus achieved at higher levels of elongation.

The higher levels of elongation which are achieved on the film can be achieved without disruptive or crushing forces on the load because of the mechanical advantage experienced between the pulling force to the pallet and the force between the rollers.

The novel construction in the invention provides for isolation of the film roll from stretch forces which eliminates premature film failure from roll end damage or roll down of edges under force. The use of this simplified construction eliminates the use of friction brakes and freedom from the problems of those brakes such as speed variation, break away from stop position, temperature variation, wear and operator control meddling.

The use of the film web as the drive as opposed to motor driven devices also eliminates the need for compensation devices for corner passages, length/width variation or in turntable speed, as well as eliminating tension compensation devices.

It can thus be seen that the present invention provides a unique apparatus and process in that two rollers interconnected for speed differential are driven by film from the rotating load resulting in a pulling action on the film causing it to be stretched before it is applied to the load. A mechanical advantage is obtained allowing stretch during the pulling action and a slight strain recovery after the pulling action is effected when the film is stretched above the yield point and minimal frictional force is placed on the film after it leaves the rollers and is wrapped around the load. The present invention essentially eliminates the neck down of the film web normally experienced at high elongation rates. By limiting the stretching action to a minimum distance between the rollers and avoiding secondary stretch between the second roller and the load, web neck down is significantly reduced. The driving force is obtained by placing the rollers closely together and rotating in the opposite direction.

BRIEF DESCRIPTION OF THE DRAWINGS

FIG. 5 is a perspective view of the embodiment shown in FIG. 4 including an idle roller attachment;

FIG. 6 is a top plan view of the embodiment of the invention incorporating the assembly of FIG. 4.

FIG. 11 is a side elevational view of the embodiment shown in FIG. 9;

FIG. 13 is an enlarged front elevational view of the pre-stretching assembly in a closed stretching mode of operation;

DETAILED DESCRIPTION OF THE DRAWINGS

Figure 1:
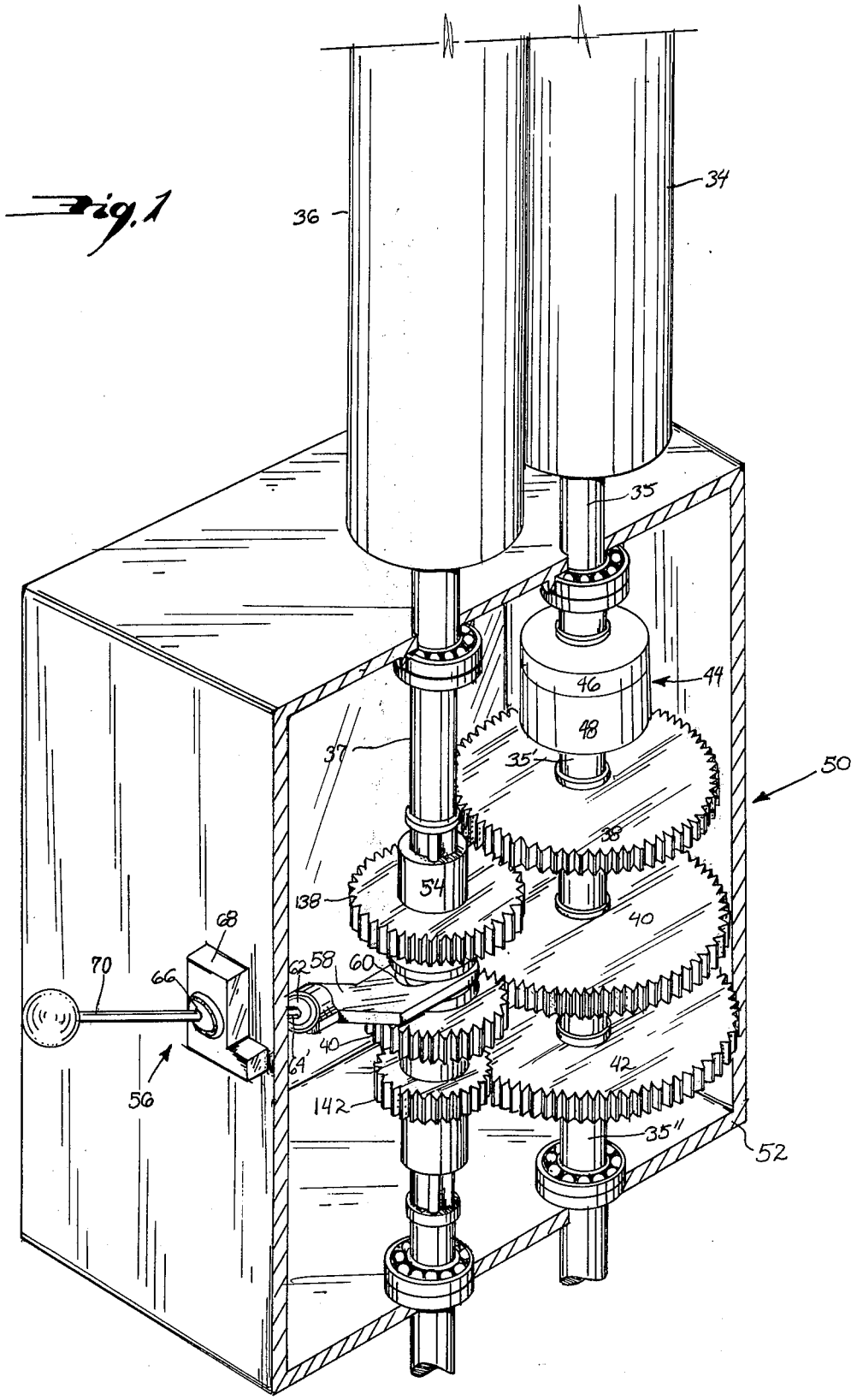
FIG. 1 is a perspective view of the roller assembly of the inventive apparatus with a portion of the apparatus broken away.
Figure 2:
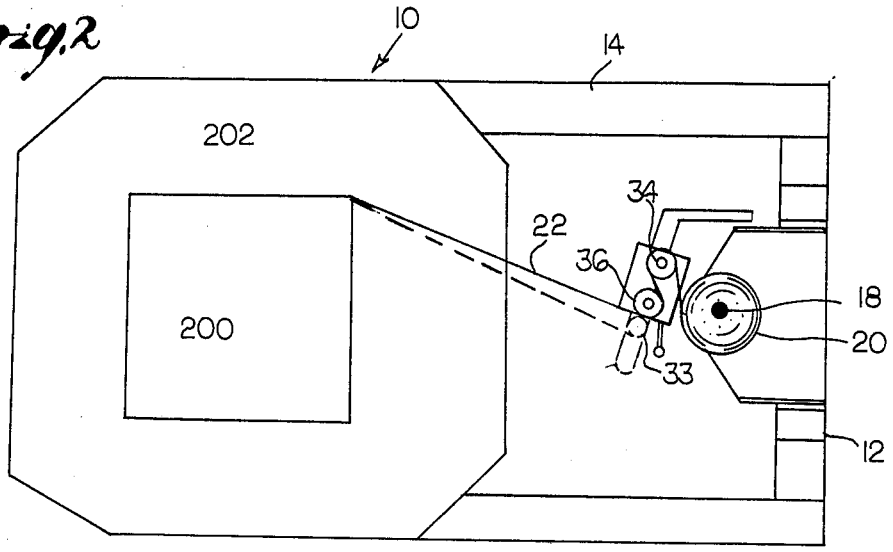
FIG. 2 is a top plan view of the preferred embodiment of FIG. 1 incorporating the assembly of FIG. 1.
Figure 3:
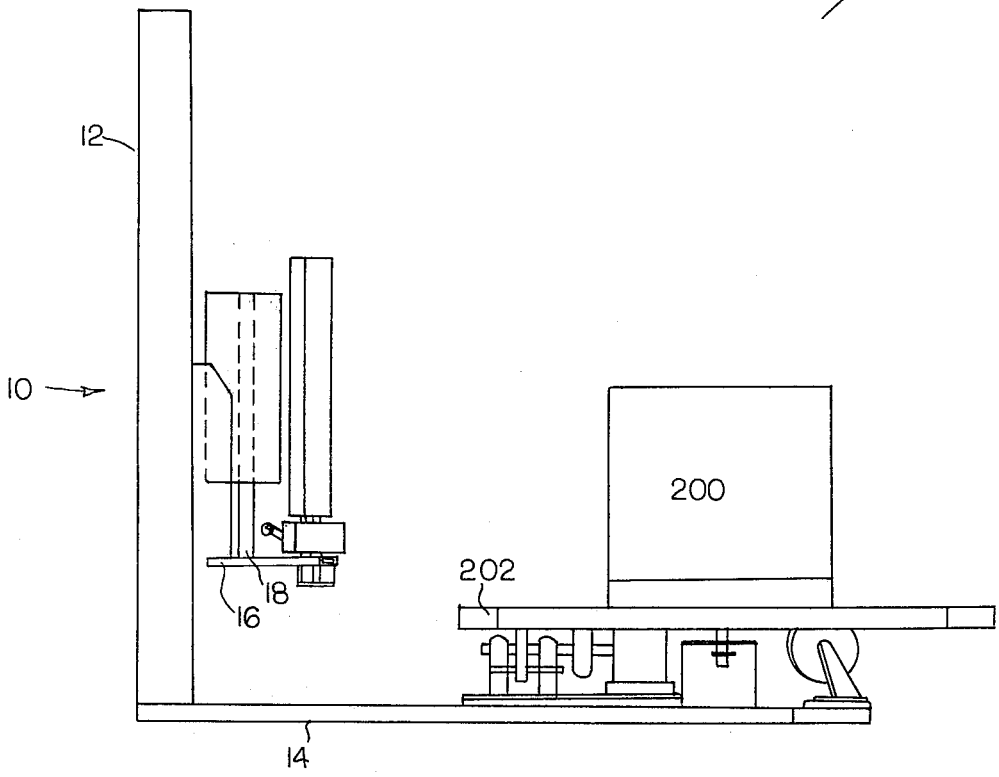
FIG. 3 is a side elevational view of the embodiment shown in FIG. 2.
Figure 14:
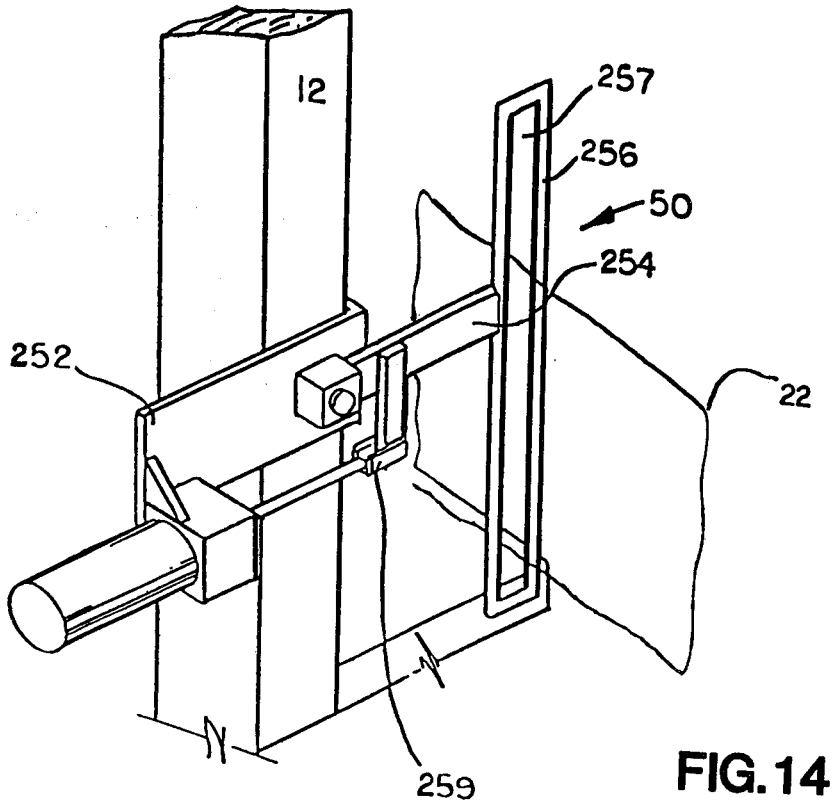
FIG. 14 is a partial perspective view of the web width changing mechanism of the apparatus when the web is in a full width open position.
Figure 15:
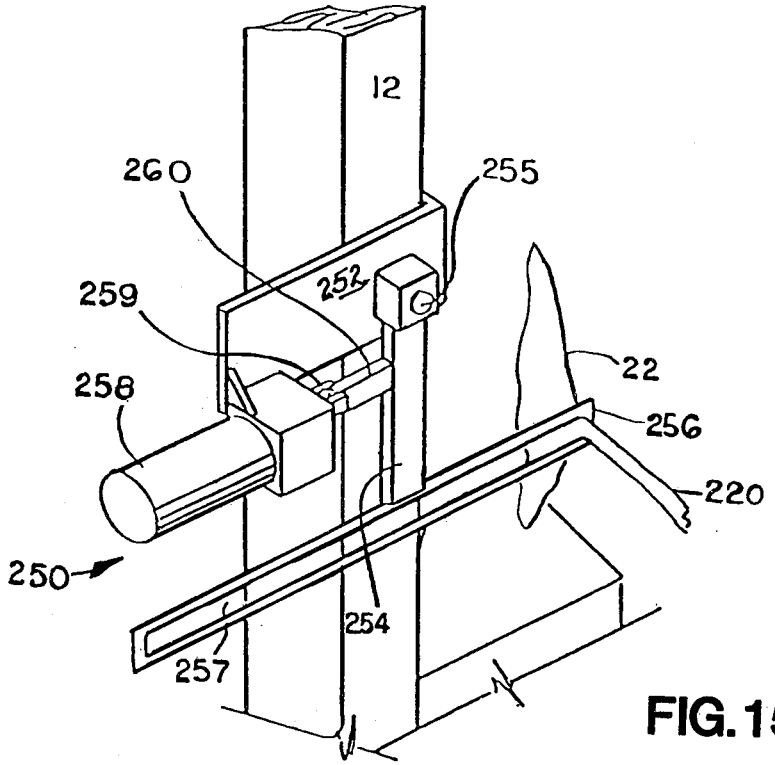
FIG. 15 is a partial perspective view of the web width changing mechanism when the mechanism is rotated to collapse the web into a rope.
Figure 16:
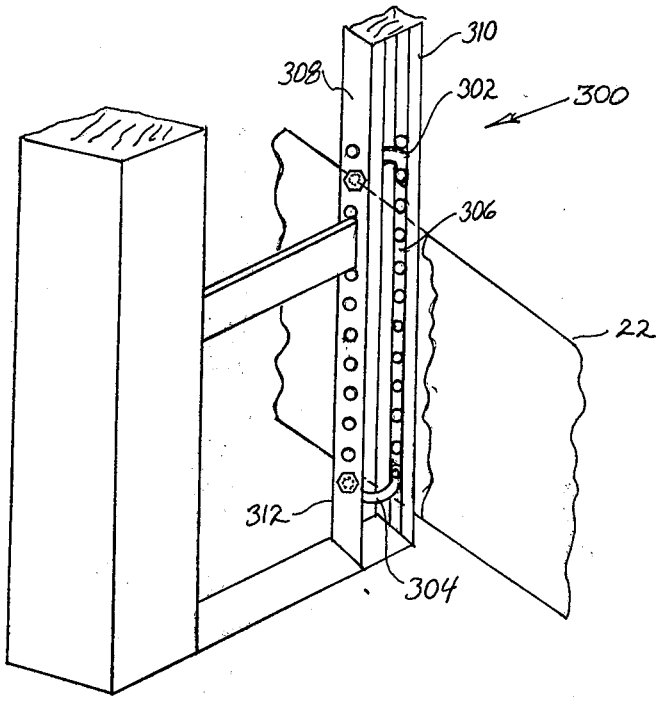
FIG. 16 is a partial perspective view of a roping mechanism with moveable fixed fingers.

The inventive wrapping apparatus 10 is shown in FIGS. 1 through 15, with the preferred mode of the invention being shown in FIGS. 1 through 3. Alternate selected embodiments of the invention are shown in FIGS. 4 through 8 and FIGS. 9 through 13. The web narrowing aspect of the invention is shown in FIGS. 14 and 15. The operation and description of the apparatus and it respective component parts are discussed in the following description.

The film web driven stretch wrapping apparatus 10 comprises an upright frame 12 sitting on a base 14. In the preferred embodiment and best mode of the invention, a carriage 16 is moveably mounted on the frame 12 as is known in the art, and is driven by rack and pinion, chain or other suitable drive means which are also well known in the art. Such stretch wrapping machines are well known in the art and are typified by machine Model Nos. SVS-80, SVSM-80, STVS-80, STVSM-80 and SAHS-80 manufactured by Lantech Inc. The apparatus 10 may also be a full web apparatus with the carriage removed, as is also well known in the art. Such machines are typified by machine Model Nos. S-65, SV-65 and SAH-70, manufactured by Lantech Inc. A typical state-of-the-art full web machine is also disclosed in U.S. Pat. No. 3,867,806. A film unwind stand 18 which is also well known in the art is mounted on the carriage 16 or base 14 in the case of a full web machine. The stand is constructed with sufficient drag to allow smooth film, without backlash, to unwind from film roll 20 to a first roller 34 which is connected to a second roller 36. The rollers are closely spaced together, geared for reverse rotation, and are rubber faced for maximum film contact. As is seen in FIG. 1, the rollers are connected by a gear assembly 50, but it should be noted that they could also be connected by chains, belts or other mechanisms such as the one shown in FIG. 3. Since most films reach their yield point before 30 percent elongation, the gear speed relationship should be variable from 30 percent to 300 percent to allow use on all stretch films which are currently available in the marketplace. In this regard, current and modified low density polyethylene should be prestretched to approximately 30 percent for optimum results. EVA copolymer films of high EVA content such as the film manufactured by Consolidated Thermoplastics "RS-50", Bemis "Super-Tough" and PPD "Stay-Tight" are effectively pre-stretched to 50–80 percent. PVC films such as Borden Resinite PS-26 are best pre-stretched at levels of 40 percent allowing maximum dwell time before restretch. Premium films such as Mobile-X, Presto Premium and St. Regis utilize a new low pressure polymerization process resin manufactured by Union Carbide and Dow Chemical Company. This resin, called linear low density polyethylene, has significantly different stretch strength characteristics than previous stretch films. These characteristics allow the film to withstand the high stress of over 100 percent elongation during prestretch and then withstand the stress of driving the connected roller system without tearing during wrapping of the pallet. In the preferred embodiment of the invention, as shown in FIGS. 1 and 3, rollers 34 and 36 are respectively secured to rotatable shafts 35 and 37 which are in turn mounted in respective journals, secured to a support member 42 or housing 52. The housing 52 is preferably secured to carriage stand 16. An idle roller 33 engaging roller 36 as shown in phantom in FIG. 2 can alternately be used with the invention to provide additional recovery time for the stretched film.

The gear changing assembly 50 comprises a housing 52 in which roller shafts 35 and 37 are respectively rotatably mounted. Three gear members 38, 40 and 42 are mounted on shaft 35 and adapted to be rotated by the film web 22 engaging roller 34. A clutch assembly 44 is also mounted to shaft 35 connecting the shaft freewheel portion 35' to the shaft gear portion 35''. A clutch plate 46 is secured to the end of shaft portion 35' opposite the face of clutch member 48 secured to the end of shaft portion 35''. When the clutch is operative, the clutch plate 46 is held on the clutch face 48 so that the three gear members 38, 40 and 42 rotate simultaneously with roller 34. When the clutch is not operative or energized, the roller 34 freewheels or turns without rotating the gears thus allowing a film web to be easily threaded through the roller assembly and attached to the load. The gear members 38, 40 and 42 are adpated to selectively engage and mesh with opposing gear members 138, 140 and 142 which are secured to sleeve 54, moveably mounted on shaft 37. The sleeve 54 is preferably splined or keyed so that it can be axially moved along the splined or keyed shaft 37 but driven by the shaft when the shaft turns. A shift mechanism 56 is used to selectively position the sleeve 54 along the shaft 37 so that a desired gear on sleeve 54 may be brought into meshing relationship with a corresponding gear on shaft 35 allowing the predetermined gear ratio to be obtained. In this regard, it should be noted that gears 38, 40 and 42 are preferably constructed of plastic, while gears 138, 140 and 142 are constructed of steel or some different material to obtain a low coefficient of friction so that the apparatus will work with a minimum of friction. Alternately, gears 138, 140 and 142 and/or their associated sleeve 54 could be constructed of plastic and gears 38, 40 and 42 could be constructed of steel. The shift mechanism 56 comprises a member 58 with a yoke 60 on one end engaging sleeve 54 and adapted to move sleeve 54 along shaft 37. The other end of member 58 forms a seat for bearing 62 of shift arm 64. The shift arm 64 can extend outside of housing 52 or it can have a pivot bearing 66 mounted in journal 68 of housing 52. Extender arm 70 extends outside of housing 52 allowing the operator to shift into the desired gear ratio. The shift mechanism is adapted to hold the gears in a locked position of selective engagement or a neutral non-engaging position.

Figure 4:
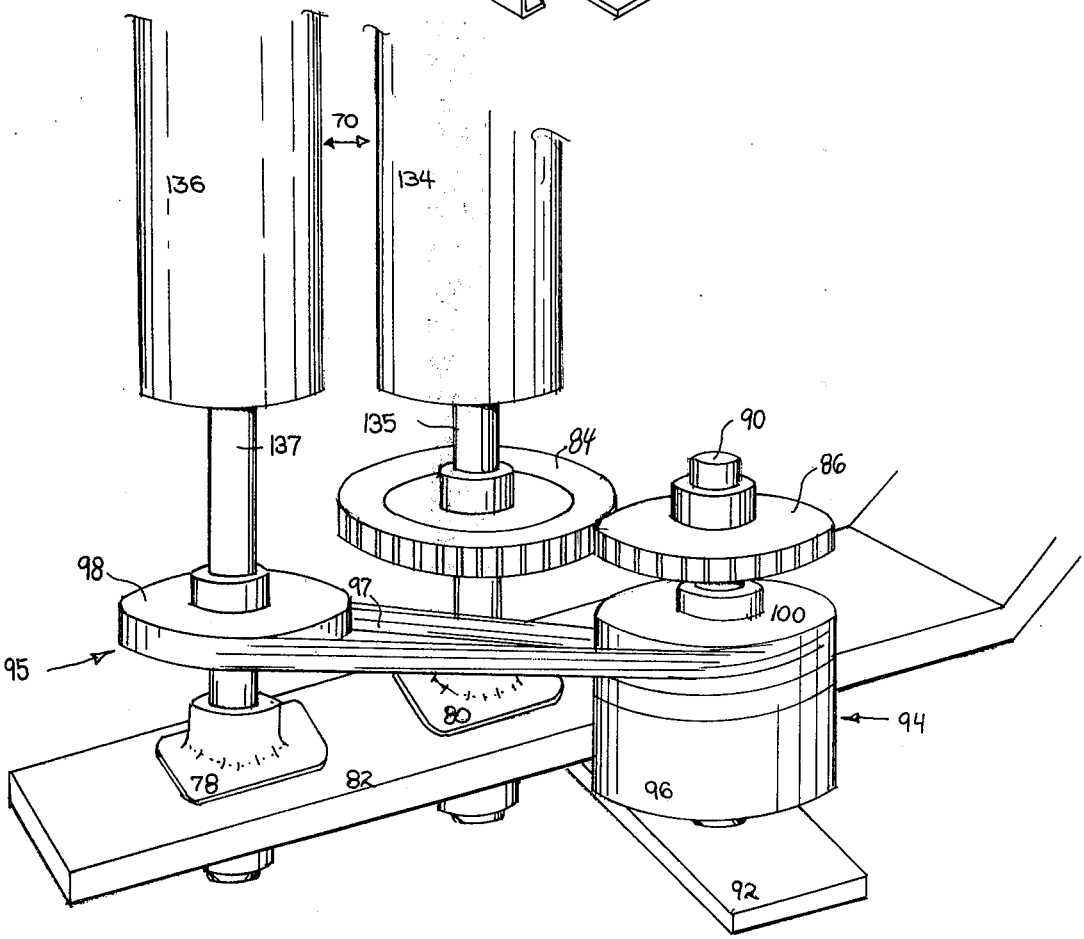
FIG. 4 is a perspective view of another embodiment of the inventive apparatus with a portion of the apparatus broken away.
Figure 7:
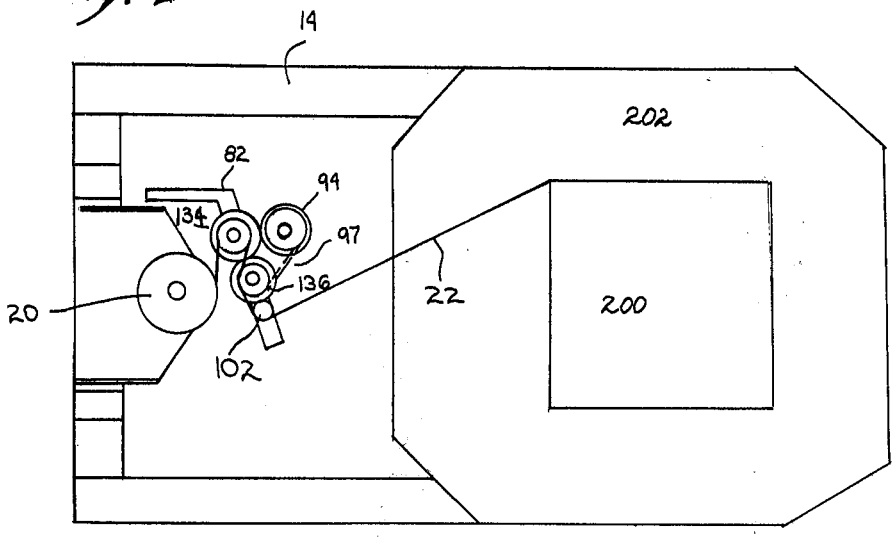
FIG. 7 is a top plan view of the inventive embodiment including the assembly shown in FIG. 5.
Figure 8:
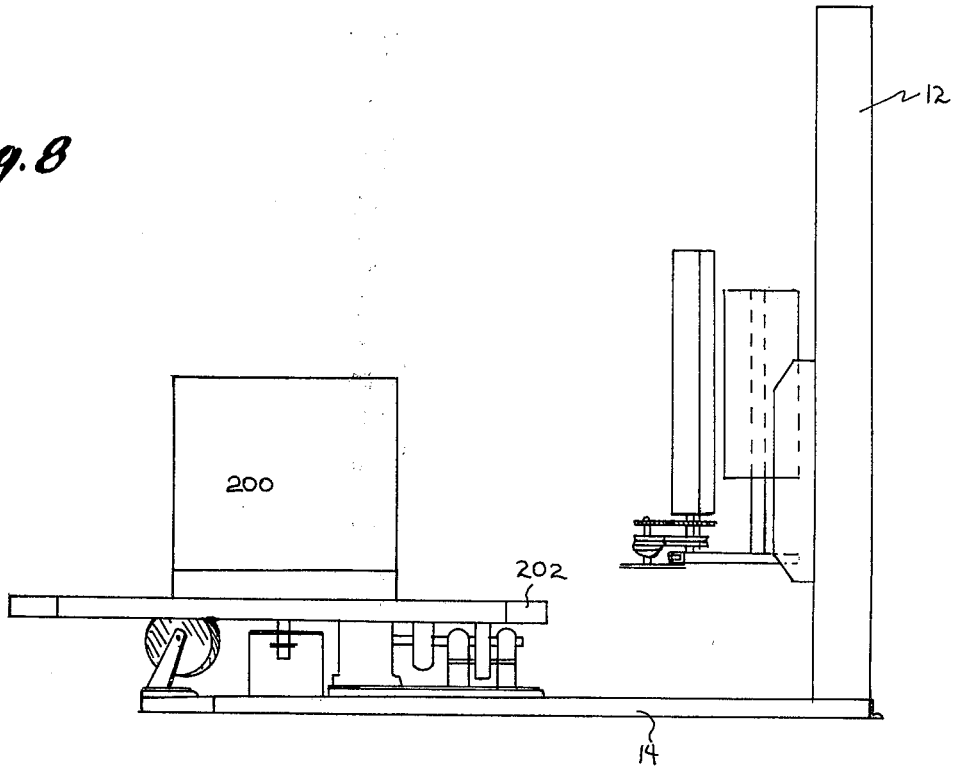
FIG. 8 is a side elevational view of the inventive embodiment shown in FIG. 6.
Figure 9:
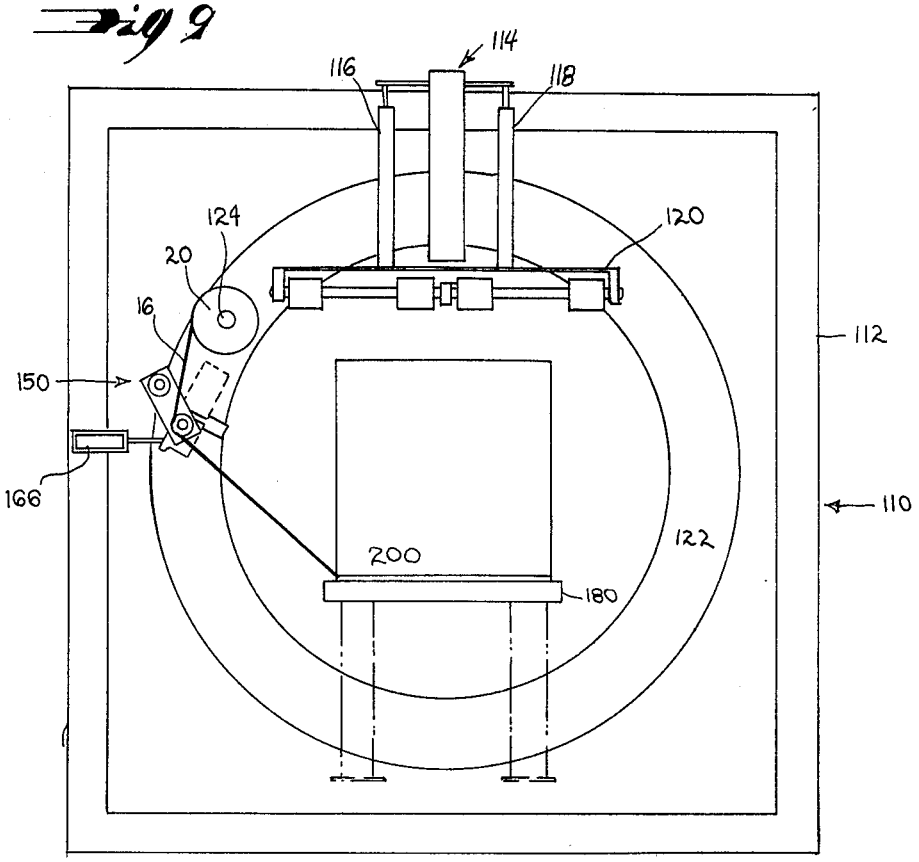
FIG. 9 is a front elevational view of another embodiment of the inventive apparatus.
Figure 10:
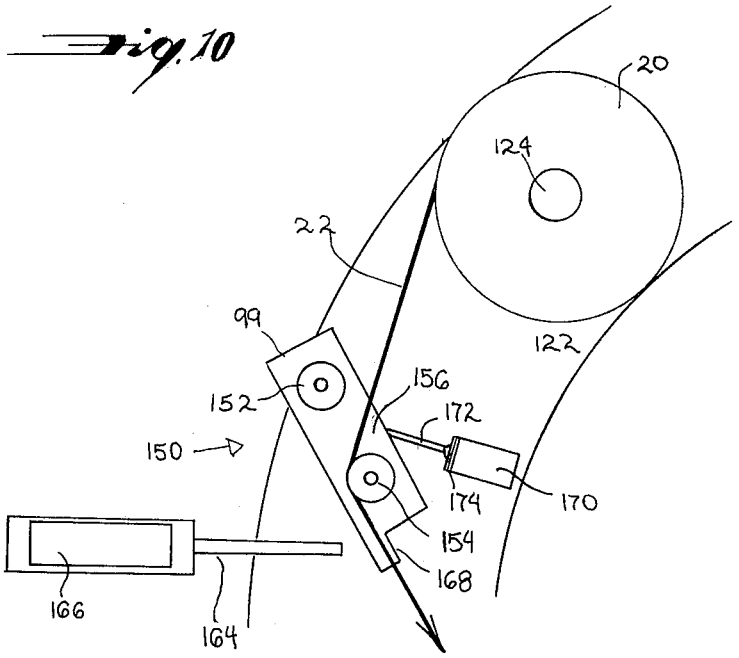
FIG. 10 is an enlarged partial front elevational view of the pre-stretching assembly in an open position as shown in FIG. 9.

In another embodiment of the invention, as shown in FIGS. 4 and 5, rollers 134 and 136 are respectively mounted onto shafts 135 and 137 which are in turn mounted in respective journals 78 and 80 secured to a support member 82 which is in turn secured to the carriage stand 16. A pinion gear 84 is mounted to shaft 135 of roller 134 and engages the teeth of an opposing gear 86 mounted to shaft 90 which is rotatably mounted in a journal (not shown) secured to cross member 92. The cross member 92 is secured to the support bar 82. A clutch assembly 94 comprising a clutch 96 and a variable double sheave 95 which is well known in the art is adapted to transmit the drive of roller 134 to roller 136 through a variable belt drive 97 mounted on a V-pulley 98 secured to shaft 90 and a V-pulley 100 which freewheels on shaft 90. Upon engagement of the clutch 96, the freewheeling pulley 100 is rotated by the shaft 90 to drive roller 136 at a variable speed which is dependent upon the particular setting of the variable belt 97. This type of drive is well known in the art and alternate variable speed drives could be substituted for the particular drive shown without departing from the spirit of the invention.

An alternate embodiment of the invention is shown in FIGS. 9 through 13 and utilizes an apparatus which rotates the film around the load rather than the rotation of the turntable carrying the load. Such apparatus is disclosed in U.S. Pat. Nos. 4,050,220 and 4,110,957, and are assigned to Lantech Inc. These patents are incorporated by reference into the specification of this application. In the embodiment most plainly shown in FIGS. 9 through 13, a rotating ring apparatus 110 is mounted on a frame 112. A load stabilizer 114 is also mounted to the frame 112 and has pneumatically operated cylinders 116 and 118 connected to a load engagement mechanism 120. The cylinders 116,118 are adapted to selectively drive the load engagement mechanism 120 downward to hold the load 200 in a stable position during wrapping. The rotatable ring member 122 is rotatably mounted to the frame 112. Means of rotating such ring member 122 are well known in the art and are shown in U.S. Pat. Nos. 4,110,957 and 4,050,220. Such machines are typified by machine Model No. SAVRB manufactured by Lantech Inc.

Figure 12:
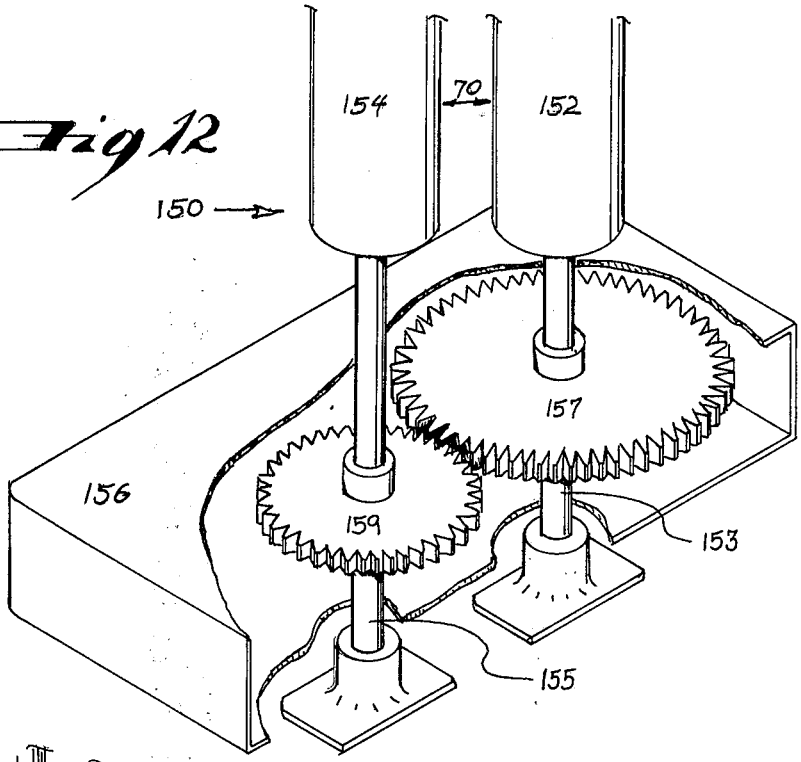
FIG. 12 is an enlarged partial perspective view of the gear housing of the rollers shown in FIG. 11.

A film roll 20 is mounted to the ring member 122 by placing it on a mandrel 124 secured to the ring member. The film web 22 is passed through a pre-stretching assembly 150 and tucked or fastened underneath load 200 as is shown in FIG. 11. The pre-stretching mechanism 150 comprises connected roller members 152 and 154 which are rotatably mounted on respective shafts 153 and 155 which are in turn journalled onto a housing 156 which is rotatably mounted by means of a pivot assembly 158 to the ring member 122. The rollers 152 and 154 are connected together by gears 157 and 159 as shown in FIG. 12 which mesh together and are driven as the film web 22 engages the rubber roller surfaces of the rollers driving the rollers. The gears 157 and 159 are similar to the gear members shown in FIG. 1 and operate in a similar manner so that the film web will drive the downstream roller at a faster rate than the upstream roller causing the film to be stretched between space 70 of the two rollers. The pre-stretching mechanism 150 is rotatable so that the film may be threaded through the mechanism and wrapped around the load 200 in a substantially unelongated condition until such time as at least a first corner of the load is covered with unstretched film.

Before the start of the film wrap, a pneumatic cylinder 166 mounted to frame 112 is activated causing piston rod 164 to extend outward and engage the cam portion 168 of housing 156, pushing the cam portion inward toward the center of the ring so that roller member 152 does not engage the film web 22. Since the connected roller members do not both engage the film web, the film web can be easily threaded through the mechanism and tucked into the load. After the leading edge of the film web has been tucked, the wrap cycle is activated by the operator and the piston rod 164 is retracted into the pneumatic cylinder away from housing 156. A coil spring (not shown) engages the housing and the shaft on which it is rotatably mounted to constantly urge the housing away from the center of the ring so that both roller members 152 and 154 will engage the film web 22. A fluid damper 170 of a type well known in the art secured to the ring member 122 engages a side of the housing 156 to prevent the roller member 152 from immediately engaging the film web. The piston 174 is provided with a suitable orifice allowing the force of the coil spring to gradually push piston rod 172 and its associated piston 174 inward at a predetermined speed allowing an appropriate amount of unelongated film web to be rotated around the load 200. The load 200 is mounted on a conveyor assembly 180 which can be powered or operated by push through methods which are well known in the art.

In operation of the preferred embodiment as shown by FIGS. 1 through 3, the film web 22 is pulled from the film roll and threaded through the film roll unwind stand and around the two rollers 34 and 36 and then attached to the load 200 by attaching it to a clamp mounted to the turntable or tucking it in the load. A release system such as clutch assembly 44 shown in FIG. 1 or clutch assembly 94 as shown in FIG. 4 can be used to ease the tucking or start up for full web or high modulus film applications. The turntable 202 is activated causing the film web 22 to be pulled across the first roller 34 thereby precisely increasing the speed for the second roller 36 to a predetermined ratio controlled by the gear assembly. As indicated in FIG. 1, the connection means can be a gear transmission or as shown in FIG. 4, a variable belt means. The film is thereby precisely elongated by a percentage represented by the relative speed differential of the rollers. When the friction in the system is minimal, the film elongation is halted when the web reaches the second roller. Thus, the film is held at a constant tension level for a period beginning with contact of the film on the second roller and ending when the film leave contact with the second roller and moves toward the unit load 200. During this period, this strain achieved during the film elongation beyond the yield point is allowed to take a partial set and realize a higher effective modulus.

As the film leaves the second roller, it normally experiences a stress reduction because of the mechanical advantage over the first pulling action represented by the speed difference of the rollers less any friction in the film unwind and roller system. This stess reduction causes inelastic strain recovery because the film was originally elongated beyond the yield point. When the apparatus is relatively friction free, meaning that the friction force is less than 10 percent of the force required to elongate the film, substantially all of the elongation occurs between the two closely spaced rollers 34 and 36. When the friction force is increased in the system, additional pulling forces occur on the film after it leaves the second roller and moves toward the load. When the friction force in the system results in less than 50 percent of the film elongation occurring between the rollers it has been noted that web breakage occurs which prevents effective usage of the apparatus. It should be noted that high friction force causes necking down of the film after it leaves the second roller which is an undesirable film characteristic. The unit load is then either spiral or full web wrapped in a conventional manner. Where desirable, the film can be roped either upstream or downstream of the roller system as is shown in FIGS. 14 and 15. The roper mechanism 250 comprises a support plate 252 secured to the frame 12, and a rotatable support bar 254 having one end rotatably mounted to the support plate, the other end being secured to the web reduction member 256. Web reduction member 256 comprises a rectangular shaped bar which defines a rectangular aperture 257. The length of the rectangular aperture is greater than the width of the web of material used for wrapping the load and the thickness of the rectangular aperture is greater than the thickness of the web. Preferably, it is also equal to the desired thickness of the web when the edges are roped so that when member 256 is rotated, web material 22 is roped into a width 220 substantially equal to the width of aperture 257 as is best shown in FIG. 14.

A pneumatically activated cylinder 258 is secured to the support plate 252 or the frame and has an end 259 of its piston rod rotatably connected to drive bar 260 which is in turn rotatably secured to the rotatable support bar 254. Cylinder 258 can be energized by known fluid circuitry to move the rotatable support bar so that it rotates around the pivot point carrying the web reduction member 256 upward or downward in an approximately 90° arc. This causes the web material to be formed into a rope configuration 220 when the rectangular member is parallel to the ground or alternately allows free flow of the open web through the web reduction member 256 when the web reduction member is positioned substantially perpendicular to ground. While most roping procedures utilize the roping mechanism upstream from the prestretching apparatus; another roping mechanism 300 with movable fixed fingers 302,304 moveably mounted in grooves 306,308 formed in guides 310,312 may be placed upstream from the roll where continuous edge roping is desirable.

Friction can also be added to the film unwind or roller system where higher levels of elongation or containment are desirable and film or load profile characteristics allow.

Recent testing using a 40"×48" pallet achieved 200 percent effective elongation on a load after a 160 percent pre-stretch using Mobil-X. An elongation on the load of 70 percent was achieved with PPD "Stay-Tight" 3520 film after a pre-stretch of 80 percent. Stretch levels were measured by printing "X" marks on the film at 10 inch intervals. The interval was measured on the pallet and the percentage calculated. Pulling force was monitored on the secondary action between the second roll and the pallet using strain gauge and strip recorder. Forces for all films tested were observed to be significantly below the theoretical forces required for the pre-stretch level to be achieved thus illustrating the mechanical advantage achieved. While friction prevents exact mechanical advantage force ratios from being realized, force monitoring indicated no distortion for corner passing, pallet centering on turntable or turntable speed. It should be noted that equivalent friction brake tests using Lantech model SVS-80 were able to obtain only a 50–60 percent elongation on Mobil-X and a 30–35 percent elongation on PPD "Stay-Tight" 3520. Thus it can be seen that the process and apparatus for elongating plastic film to overwrap products for containment using two pulling actions having mechanical advantage over each other provides significant improvement over the prior art. The first pulling action is separated by a period of controlled constant strain allowing the film to take a partial set. The pulling action elongates the film between two rollers connected to rotate at different speeds which isolates the elongation action from the film roll and the pallet load. The film is then held at that level of elongation for a period to time with the surface friction of the second roller. The second pulling action with a preferred force below the previous pulling action results from interconnection of the film between the second roller and the rotating unit load in the spiral and full web embodiment. The mechanical advantage of the second pulling action over the first allows very high stretching levels to be achieved during the first pulling action. The level of elongation is typically double the level achievable with a friction brake. The lower forces experienced during the second pulling action result in some strain recovery because the yield point was exceeded and thus the force reduced. It should be noted at this point that the yield point is substantially defined by the tensile yield of the stretch film being used. The tensile yield under ASTM Test method D-882 for Mobile-X film is 980 P.S.I; Mobil-H film, 1000 P.S.I. and Mobil-C film, 1000 P.S.I. Thus the force required to reach the yield point for a given film web is found by the formula: (cross sectional area × tensile yield)/1=force at yield point.The yield point of a 20"×0.0009 inch web of Mobil-X film would therefore be 19.6 pounds.

The common tests used to determine tensile yield are the ASTM D-882 and ASTM D-638.

These lower forces allow overwrapping of the product at very high levels of elongation without disruption or crushing forces which would be incurred at equivalent levels of elongation using conventional brake type film stretch systems, if such systems could achieve the levels of elongation obtained by using the present invention.

Special applications requiring high levels of containment force can add friction to the film unwind or roller apparatus up to a level sufficient to produce elongation and higher containment during the second pulling action.

It should be noted that the steps of the wrapping process can be interchangeable without departing from the scope of the invention. Furthermore, these steps can be interchanged and are equivalent. In the foregoing description, the invention has been described with reference to a particular preferred embodiment, although it is to be understood that the specific details shown are merely illustrative and the invention may be carried out in other ways without departing from the true spirit and scope of the following claims.

What is claimed is:

1. A process of making a unitary package by wrapping a load comprising the steps of:

a. positioning a roll of stretchable plastic material on a dispenser means adjacent to said load;

b. withdrawing a leading end of said plastic material from said dispenser means through a material web pre-stretching means comprising an upstream roller means and a downstream roller means;

c. holding said plastic material adjacent said load;

d. substantially synchronizing the relative surface speed of said material in said pre-stretching means to the surface speed of said load by relative rotation of the load and said dispensing means causing the film web to be pulled partially around the surfaces of said upstream and downstream roller means of said pre-stretching means, said upstream and downstream roller means being interconnected;

e. rotating said upstream and downstream roller means at different speeds by engaging said roller means with said moving material thereby driving said roller means, the downstream roller means transporting the material at a faster rate of speed than the upstream roller means causing the material web to incur substantial elongation between said upstream and downstream roller means; and f. wrapping the load with more than one revolution of previously elongated material.

2. The process of making the package of claim 1, further including an additional step of severing said plastic material from said pre-stretching means and fastening the trailing end of said stretched material to at least one previously dispensed layer of overwrap.

3. The process of making the unitary package of claim 1, wherein said plastic material is allowed to realize inelastic strain recovery between the pre-stretching means and the load.

4. The process of making the unitary package of claim 1, wherein said plastic material is elongated beyond its yield point between said upstream and downstream rollers.

5. The process of making the unitary package of claim 1, wherein said plastic material is a low density linear polyethylene film elongated by said pre-stretching means in a range of 60 percent to 200 percent.

6. The process of making the unitary package of claim 1, wherein said plastic material is elongated by said pre-stretching means at least 100 percent over the percentage of stretch obtained by a friction brake.

7. The process of making the unitary package of claim 1, wherein said plastic material is a polyvinylchloride film.

8. The process of making the unitary package of claim 1, wherein said plastic material is pulled from the pre-stretching means by the load with a force less than the maximum force incurred by the plastic material during said pre-stretching.

9. The process of making the unitary package of claim 1, wherein the elongated material web after it leaves the pre-stretching means realizes inelastic strain recovery before it is wrapped around the load.

10. A process of making a package by wrapping a load with a stretched plastic material overwrap comprising the steps of:

a. positioning a roll of stretchable plastic film material on a dispenser means adjacent to said load;

b. withdrawing a leading end of said plastic material from said dispenser means and passing said film material partially around upstream and downstream roller assemblies which are mechanically connected and adapted to transport the film material at different speeds with the film material being driven at a faster speed at the downstream assembly than at the upstream assembly;

c. holding said film material adjacent said load;

d. rotating said load relative to said dispenser means to transport said film material around said connected roller assemblies causing said moving film material to engage and drive the connected roller assemblies such that the downstream roller assembly moves faster than the upstream roller assembly to elongate the film material beyond its yield point allowing stretched material to be wrapped around the load; and e. covering the load with a plurality of previously elongated film wraps so that the load is held under a compression force.

11. A process of making a unitary package as claimed in claim 10, including the step of allowing the elongated film material to be subjected to a second stretching action before it is wrapped around the load.

12. A process of making a unitary package as claimed in claim 11, wherein the second stretching action causes film material elongation less than 10 percent of the initial film elongation.

13. A process for wrapping stretched plastic film on a load to form a tensioned unitary package load comprising:

a. placing a roll of stretchable plastic film on a dispenser;

b. withdrawing a web of plastic film from the film roll partially around a stretching mechanism comprising an upstream roller member mechanically connected to a downstream roller member to provide constant proportional rotation between the members and attaching it adjacent the load;

c. pulling the web of plastic film through the stretching mechanism to drive the stretching mechanism by causing relative rotation between the load and the dispenser means so that the film engages and drives the roller members causing the downstream roller member to be driven faster than the upstream roller member to stretch the plastic film before it is wrapped around the surface of the load;

d. maintaining said pulling force on the film from the load to a level less than the stretching force within said stretching mechanism; and e. severing said stretched film from said stretching mechanism and fastening it to an underlying layer to form a unitary packaged load.

14. The process of claim 13 wherein said stretching mechanism does not stretch the film web during a portion of the wrap cycle so that relatively unelongated film material is wrapped around at least a part of said load.

15. A process for wrapping stretched film as claimed in claim 17 wherein step c includes pulling the film web through the stretching mechanism when the roller members are unconnected to each other to at least partially wrap the load.

16. The process of claim 17, wherein said plastic film material is a low density linear polyethylene.

17. The process of claim 13, wherein said stretchable plastic film is elongated at least 100% past its yield point.

18. The process of claim 13, wherein edges of said stretchable plastic film are roped into a reduced film web width upstream of the roller stretching mechanism.

19. A process of making a wrapped unitary package from a load comprising a plurality of units comprising:

a. removing a leading edge of a web of a roll of stretchable material from a dispensing means and passing the web through an elongation mechanism comprising operatively connected spaced apart upstream and downstream rollers so that the web is placed at least partially around the roller surfaces;

b. holding said web of stretchable material adjacent to said load;

c. providing relative rotation between the load and the dispensing means thereby pulling the web past said rollers of said elongation mechanism to engage and drive said rollers so that the upstream roller is driven at a first speed and said downstream roller is driven at a second higher speed elongating the web beyond its yield point in the space between the rollers;

d. controlling the relative speed of said upstream roller to said downstream roller so that said upstream roller rotates at said first speed and said downstream roller rotates at said second higher speed elongating the web between the rollers a predetermined amount; and e. wrapping the elongated web around the load.

20. A process as claimed in claim 19, wherein said elongated web is spirally wrapped around said load.

21. A process as claimed in claim 19 wherein said elongated web is netting.

22. The process as claimed in claim 19, wherein the elongation means applies a force on the film web which is greater than the:

(cross-sectional area of the film web × tensile yield of the film)/1 elongating the web.

23. An apparatus for making a unitary package using a single web of stretchable plastic material to form the overwrap comprising a frame, a dispenser means, said dispenser means being adapted to hold and dispense a roll of stretchable material, a means for providing relative rotation between the load and dispenser means to pull said material off of said dispenser means, elongation means connected to said dispenser means adapted to receive stretchable material pulled from said dispenser means, said elongation means comprising at least a downstream and an upstream roller closely spaced apart and interconnected by speed control means and driven by engagement of the moving material pulled from the dispenser means by relative rotation of the load and dispenser means, said rollers being acted upon by said speed control means so that said downstream roller transports the material faster than said upstream roller to cause the material to elongate before it passes the downstream roller, with the mechanical advantage of said pulling force over stretching force between rollers being sufficient to maintain said pulling force less than said stretching force.

24. Apparatus as claimed in claim 23, wherein said two rollers are connected by a downstream roller gear and upstream roller gear, said gears being adapted to be disconnected by clutch means mounted to one of said rollers.

25. An apparatus as claimed in claim 23, wherein said speed control means is a variable belt mechanism comprising a gear engaging a gear of one roller and a double split sheave assembly connected to a pulley member mounted to said second roller, said clutch being operative to adjustably engage said double split sheave assembly.

26. Apparatus as claimed in claim 23, including an idle roller means mounted to said downstream roller means.

27. An apparatus as claimed in claim 23, wherein said speed control means comprises a gear transmission assembly including a plurality of gears adapted to selectively interconnect to arrive at the selective gear ratio.

28. An apparatus for making a unitary package from a load using a single web of stretchable plastic material to form the overwrap, comprising a frame, a film dispenser means mounted on said frame, said film dispenser means being adapted to hold a roll of stretchable plastic material and dispense the material, means to provide relative rotation of the load and the film dispenser means to pull said material off of said dispenser means, elongation means connected to said frame adapted to receive stretchable plastic material from said film dispenser means and elongate said plastic material, said elongation means comprising at least two rollers spaced apart so that one roller occupies an upstream roller position and the other roller occupies a downstream roller position, said rollers being connected by roller speed control means said rollers being driven by engagement of the moving plastic material pulled from the dispenser means by the relative rotation of the load so that said downstream roller transports the plastic material faster than said upstream roller to cause the plastic material to elongate between the rollers with said plastic material receiving at least 50 percent of its elongation between the rollers before it reaches the load, the rotation of the load causing a plurality of layers of prestretched material to be placed around said load to form a wrapped tensioned unitary package.

29. An apparatus as claimed in claim 28, wherein said roller speed control means are interconnecting gears, each gear being secured to the shaft of a roller.

30. Apparatus as claimed in claim 29, wherein the rotation ratio of a downstream roller gear to an upstream roller gear ranges from 3 to 2 to 5 to 2.

31. Apparatus as claimed in claim 29, including clutch means connected to said gears, said clutch means providing adjustable engagement of the gears.

32. Apparatus as claimed in claim 29, wherein the rotation ratio of a downstream roller gear to an upstream roller gear produces a force on said plastic material greater than the: (x-sectional area of the film × tensile yield of the film)/1.

33. Apparatus as claimed in claim 29, wherein the rotation ratio of a downstream roller gear to an upstream roller gear is in excess of 2 to 1.

34. Apparatus as claimed in claim 29, wherein each connecting gear is constructed of a different material to reduce friction.

* * * * *

REEXAMINATION CERTIFICATE (212th)

United States Patent [19] [11] B1 4,302,920

Lancaster et al. [45] Certificate Issued Jun. 19, 1984

[54] FILM WEB DRIVE STRETCH WRAPPING APPARATUS AND PROCESS

[75] Inventors: Patrick R. Lancaster, Anchorage; William G. Lancaster, Louisville, both of Ky.

[73] Assignee: Lantech Inc., Louisville, Ky.

Reexamination Request:
No. 90/000,463, Oct. 28, 1983

Reexamination Certificate for:

| | |
|---|---|
| Patent No.: | **4,302,920** |
| Issued: | **Dec. 1, 1981** |
| Appl. No.: | **96,384** |
| Filed: | **Nov. 21, 1979** |

[51] Int. Cl.[3] ..... B65B 11/04

[52] U.S. Cl. ..... 53/399; 53/441; 53/556; 53/587

[56] References Cited

U.S. PATENT DOCUMENTS

| | | |
|---|---|---|
| 2,432,828 | 12/1947 | Stone . |
| 2,636,249 | 4/1953 | Lee . |
| 2,759,728 | 8/1956 | Huck . |
| 2,999,295 | 9/1961 | Manning et al. . |
| 3,052,917 | 9/1962 | Horn . |
| 3,076,232 | 2/1963 | Dengler . |
| 3,087,663 | 4/1963 | Anderson et al. . |
| 3,198,453 | 8/1965 | Aaron . |
| 3,261,903 | 7/1966 | Carr . |
| 3,370,768 | 2/1968 | O'Toole . |
| 3,445,886 | 5/1969 | Lemoine et al. . |
| 3,539,085 | 11/1970 | Anderson . |
| 3,577,497 | 5/1971 | Matsugu et al. . |
| 3,608,056 | 9/1971 | Nelson . |
| 3,659,000 | 4/1972 | Cronk . |
| 3,667,664 | 6/1972 | Schroeder . |
| 3,759,432 | 9/1973 | Hutzenlaub . |
| 3,762,662 | 10/1973 | Owens . |
| 3,891,737 | 6/1975 | Marsh et al. . |
| 3,977,621 | 8/1976 | Huffman . |
| 4,003,525 | 1/1977 | Podvin et al. . |
| 4,103,840 | 8/1978 | Dowd . |
| 4,277,594 | 7/1981 | Matthews et al. . |

*Primary Examiner*—John Sipos

[57] ABSTRACT

A process and apparatus for applying stretchable plastic film to loads for containment of the loads using two connected rollers driven by the film web so that the rollers are driven at different speeds to elongate the plastic film beyond its yield point and wrapping the elongated film after it has been stretched past its yield point around a rotating load. A roller can be added to the apparatus to increase the set time for the elongated film after it is stretched by the connected rollers. In addition, a web narrowing device may be placed upstream or downstream from the apparatus to reduce the hazard of edge tear under high elongation forces.

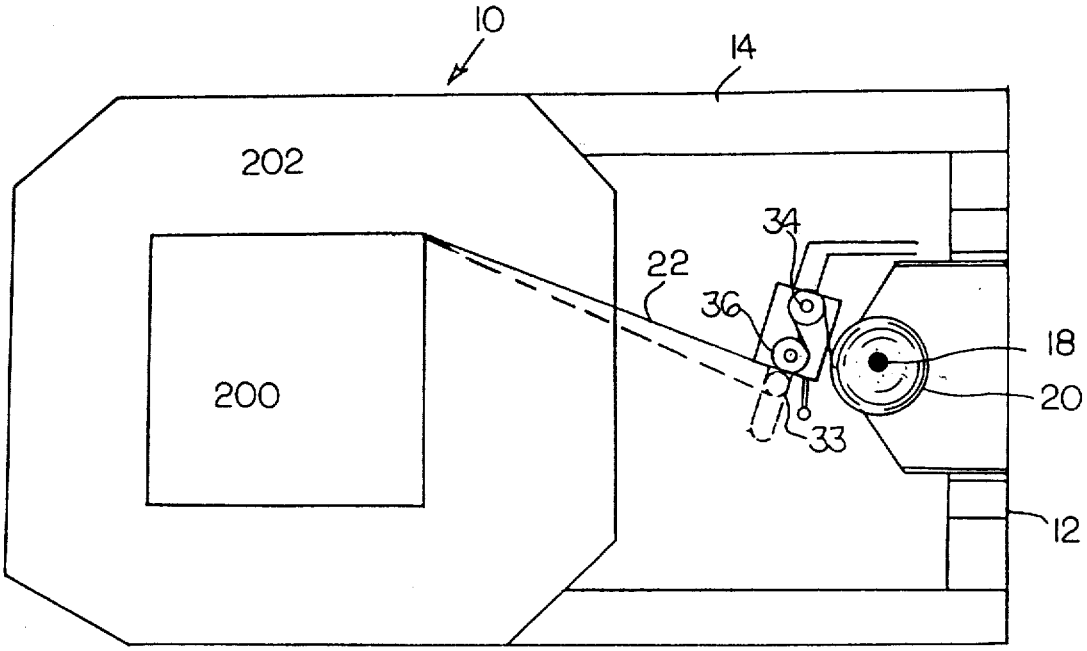

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 10, 13–15, 19, 22–25, and 28 are determined to be patentable as amended:

Claims 2–9, 11, 12, 16–18, 20, 21, 26, 27 and 29–34, dependent on amended claims, are determined to be patentable.

1. A process of making a unitary package by wrapping a load comprising the steps of:

a. positioning a roll of stretchable plastic material on a dispenser means adjacent to said load;

b. withdrawing a leading end of said plastic material from said dispenser means through a material web pre-stretching means comprising an upstream roller means and a downstream roller means;

c. holding said plastic material adjacent said load;

d. substantially synchronizing the relative surface speed of said material in said pre-stretching means to the surface speed of said load by relative rotation of the load and said dispensing means causing the film web to be pulled partially around the surfaces of said upstream and downstream roller means of said pre-stretching means, said upstream and downstream roller means being *rotationally* interconnected *so that the downstream roller means rotates faster than the upstream roller means*;

e. rotating said upstream and downstream roller means at different speeds by engaging said roller means with said moving material thereby driving said roller means, *said roller means being driven solely by engagement of said moving material with* the downstream roller means transporting the material at a faster rate of speed than the upstream roller means causing the material web to incur substantial elongation between said upstream and downstream roller means; and f. wrapping the load with more than one revolution of previously elongated material.

10. A process for making a package by wrapping a load with a stretched plastic material overwrap comprising the steps of:

a. positioning a roll of stretchable plastic film material on a dispenser means adjacent to said load;

b. withdrawing a leading end of said plastic material from said dispenser means and passing said film material partially around upstream and downstream roller assemblies which are mechanically *rotatively* connected [and adapted] *so that the downstream roller assembly rotates faster than the upstream roller assembly* to transport the film material at different speeds with the film material being driven at a faster speed at the downstream assembly than at the upstream assembly;

c. holding said film material adjacent said load;

d. rotating said load relative to said dispenser means to transport said film material around said connected roller assemblies causing said moving film material to engage and drive the connected roller assemblies such that the downstream roller assembly moves faster than the upstream roller assembly to elongate the film material beyond its yield point allowing stretched material to be wrapped around the load, *said roller assemblies being driven solely by said moving material*; and e. covering the load with a plurality of previously elongated film wraps so that the load is held under a compression force.

13. A process for wrapping stretched plastic film on a load to form a tensioned unitary package load comprising:

a. placing a roll of stretchable plastic film on a dispenser;

b. withdrawing a web of plastic film from the film roll partially around a stretching mechanism comprising an upstream roller member mechanically *rotationally* connected to a downstream roller member to provide constant proportional rotation between the members *so that one roller member rotates faster than the other roller member* and attaching it adjacent the load;

c. pulling the web of plastic film through the stretching mechanism to drive the stretching mechanism by causing relative rotation between the load and the dispenser means so that the film engages and drives the roller members causing the downstream roller member to be driven faster than the upstream roller member to stretch the plastic film before it is wrapped around the surface of the load, *said roller members being driven solely by engagement of said moving film;* d. maintaining [said] *a* pulling force on the film from the load to a level less than the stretching force within said stretching mechanism; and e. severing said stretched film from said stretching mechanism and fastening it to an underlying layer to form a unitary packaged load.

14. The process of claim 13 wherein said stretching mechanism does not stretch the film web during a portion of the wrap [cycle] so that relatively unelongated film material is wrapped around at least a part of said load.

15. A process for wrapping stretched film as claimed in claim *13* [17] wherein step c includes pulling the film web through the stretching mechanism when the roller members are unconnected to each other to at least partially wrap the load.

19. A process of making a wrapped unitary package from a load comprising a plurality of units comprising:

a. removing a leading edge of a web of a roll of stretchable material from a dispensing means and passing the web through an elongation mechanism comprising operatively connected spaced apart upstream and downstream rollers so that *the downstream roller rotates faster than the upstream roller and* the web is placed at least partially around the roller surfaces;

b. holding said web of stretchable material adjacent to said load;

c. providing relative rotation between the load and the dispensing means thereby pulling the web past said rollers of said elongation mechanism to engage and drive said rollers so that the upstream roller is driven at a first speed and said downstream roller is driven at a second higher speed elongating the web beyond its yield point in the space between the rollers, *said rollers being driven solely by engagement of the moving web*;

d. controlling the relative speed of said upstream roller to said downstream roller so that said upstream roller rotates at said first speed and said downstream roller rotates at said second higher speed elongating the web between the rollers a predetermined amount; and e. wrapping the elongated web around the load.

22. The process as claimed in claim 19, wherein the elongation means applies a force on the film web which is greater than the:

(cross-sectional area of the film web × tensile yield of the film *web*)/1 [elongating the web].

23. An apparatus for making a unitary package using a single web of stretchable plastic material to form the overwrap comprising a frame, a dispenser means, said dispenser means being adapted to hold and dispense a roll of stretchable material, a means for providing relative rotation between the load and dispenser means to pull said material off of said dispenser means, elongation means connected to said dispenser means adapted to receive stretchable material pulled from said dispenser means, said elongation means comprising at least a downstream and an upstream roller closely spaced apart and *rotationally* interconnected by speed control means *so that one roller rotates faster than the other roller,* [and] *said rollers being solely* driven by engagement of *said rollers with* the moving material pulled from the dispenser means by relative rotation of the load and dispenser means, said rollers being acted upon by said speed control means so that said downstream roller transports the material faster than said upstream roller to cause the material to elongate before it passes the downstream roller, with the mechanical advantage of [said] *the* pulling force over stretching force between rollers being sufficient to maintain said pulling force less than said stretching force.

24. Apparatus as claimed in claim 23, wherein said two rollers are *rotationally* connected by a downstream roller gear and upstream roller gear, said gears being adapted to be disconnected by clutch means mounted to one of said rollers.

25. An apparatus as claimed in claim 23, wherein said speed control means is a variable belt mechanism comprising a gear engaging a gear of one roller and a double split sheave assembly connected to a pulley member mounted to said second roller, *and further including a* [said] clutch being operative to adjustably engage said double split sheave assembly.

28. An apparatus for making a unitary package from a load using a single web of stretchable plastic material to form the overwrap, comprising a frame, a film dispenser means mounted on said frame, said film dispenser means being adapted to hold a roll of stretchable plastic material and dispense the material, means to provide relative rotation of the load and the film dispenser means to pull said material off of said dispenser means, elongation means connected to said frame adapted to receive stretchable plastic material from said film dispenser means and elongate said plastic material, said elongation means comprising at least two rollers spaced apart so that one roller occupies an upstream roller position and the other roller occupies a downstream roller position, said rollers being *operatively* connected by roller speed control means, *so that the downstream roller rotates faster than the upstream roller,* said rollers being *solely* driven by engagement of the moving plastic material pulled from the dispenser means by the relative rotation of the load so that said downstream roller transports the plastic material faster than said upstream roller to cause the plastic material to elongate between the rollers with said plastic material receiving at least 50 percent of its elongation between the rollers *and* before it reaches the load, the rotation of the load causing a plurality of layers of pre-stretched material to be placed around said load to form a wrapped tensioned unitary package.

* * * * *